United States Patent [19]

Kerst

[11] 4,278,635

[45] Jul. 14, 1981

[54] METHOD FOR DEOXYGENATION OF WATER

[75] Inventor: Herman Kerst, Des Plaines, Ill.

[73] Assignee: Chemed Corporation, Cincinnati, Ohio

[21] Appl. No.: 107,486

[22] Filed: Dec. 26, 1979

Related U.S. Application Data

[63] Continuation-in-part of Ser. No. 84,520, Oct. 12, 1979, abandoned.

[51] Int. Cl.[3] ..... C23F 11/06; C23F 11/12; C23F 11/14; C23F 11/16

[52] U.S. Cl. ..... 422/14; 210/750; 210/757; 252/178; 252/391; 252/392; 252/393; 422/16

[58] Field of Search ..... 252/391, 392, 393, 178; 422/14, 16; 210/59, 750, 757

[56] References Cited

U.S. PATENT DOCUMENTS

| | | | |
|---|---|---|---|
| 1,988,823 | 1/1935 | Winning et al. . | |
| 2,682,563 | 6/1954 | Bell et al. . | |
| 2,835,715 | 5/1958 | Tiede . | |
| 3,551,349 | 12/1970 | Kallfass | 422/16 X |
| 3,728,281 | 4/1973 | Marks et al. | 252/392 |
| 3,843,547 | 10/1974 | Kaufman et al. | 422/16 X |
| 3,983,048 | 9/1976 | Schiessl et al. | 422/16 X |
| 4,022,711 | 5/1977 | Noack | 252/393 X |
| 4,026,664 | 5/1977 | Noack | 422/16 |
| 4,079,018 | 3/1978 | Noack | 252/393 X |
| 4,096,090 | 6/1978 | Noack | 422/16 X |

OTHER PUBLICATIONS

Green et al., "The Influence of Hydroxyl Ion . . . Hydroquinone", J.A.C.S. 63, 1941, pp. 3441-3444.

*Primary Examiner*—Barry Richman
*Attorney, Agent, or Firm*—Charles L. Harness

[57] ABSTRACT

A method for boiler water treatment to retard corrosion due to dissolved oxygen. Hydroquinone and certain related compounds are highly effective oxygen scavengers for use in boiler water and thereby effect reduction of corrosion resulting from dissolved oxygen.

5 Claims, No Drawings

METHOD FOR DEOXYGENATION OF WATER

This application is a continuation-in-part of my copending Ser. No. 84,520, filed Oct. 12, 1979, Improved Product and Method for Deoxygenation of Water and now abandoned, the entire contents of which are herein incorporated by reference.

This invention relates to a method for retarding corrosion in boiler feed water systems due to dissolved oxygen by adding to the boiler water, as oxygen scavenger, hydroquinone or certain derivatives thereof. The invention is intended for use in any boiler water system, i.e., at pressures in the range of 0 to 1000 psig or higher. The metal surfaces exposed to these conditions are generally iron and steel.

In boiler systems, corrosion may occur in feed lines, heaters, economizers, boilers, steam and return lines formed of iron and steel. Dissolved oxygen in the water is a principal factor influencing corrosion of such metals. The control of the problem of the presence of oxygen in boiler systems, particularly in the feed water section, by the conventional oxygen scavengers, sodium sulfite or hydrazine, has not been entirely satisfactory, because they are not very effective at low temperatures.

Thus, although the art has known a number of oxygen scavengers for control of corrosion in boiler water systems, these have not been completely satisfactory.

It has now been found that by practice of the present invention, there is provided a new improved method for control of corrosion in boiler water systems and other aqueous systems which overcomes many of the disadvantages of prior art systems.

The oxygen scavengers (the "additive(s)") contemplated for use in this invention are the o- or p-dihydroxy, diamino, and aminohydroxy benzenes, and their lower alkyl substituted derivatives, viz.:

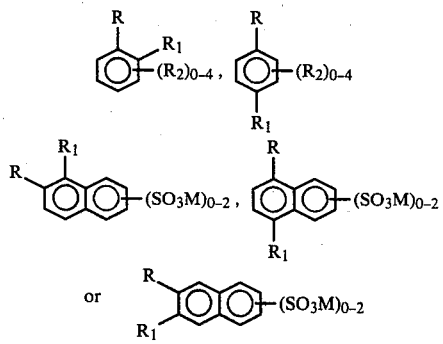

in which R and $R_1$ are independently selected from —OH or —$NH_2$, $R_2$ (when present) is one or more of low molecular weight alkyl groups, in which the alkyl group has 1–8 carbons, M is H, Na, or K or permutations thereof.

These additives may be added to feed water in an effective amount depending on the amount of oxygen present, so as to maintain a small residual of the additive at the point where it enters the boiler. The amount fed should be from 0.1 to 20, preferably 1 to 5 times the oxygen concentration, on a weight basis, and residuals of 0.1 to 1 part per million are generally adequate.

The ability of hydroquinone to react with oxygen has been known for a long time. See, e.g., Green and Branch, J.A.C.S. 63, 3441 (1941). Quinone is taught as a catalyst for hydrazine in oxygen scavenging in U.S. Pat.

No. 3,551,349. The specification mentions hydroquinone. U.S. Pat. No. 4,096,090 teaches the use of ortho disubstituted diphenols, or hydroxy amines as part of the catalyst system for catalyzing the reaction between oxygen and hydrazine. Also, by the same inventor, U.S. Pat. No. 4,026,664 covers a similar type of invention. U.S. Pat. No. 3,843,547 teaches the use of essentially the same types of ortho and para dihydroxyamine and diamino compounds covered by this specification, but merely as catalysts, present in small amounts, for the hydrazineoxygen reaction. U.S. Pat. No. 1,988,823 also teaches the use of hydroquinone as part of a rust removal composition to prevent attack on copper, brass, aluminum, or solder. However, so far as I am aware none of the class of compounds herein disclosed has ever before been used to scavenge oxygen in boiler waters, or in other closed aqueous systems.

In the specification and claims, by boiler feed water, boiler water, and boiler water system is meant the water in the boiler system plus attendant minor amounts of salts and dissolved air and/or oxygen that result from the use of commercially available waters in boiler systems. Such boiler systems may also include small amounts of additives normally used for control of corrosion, scaling, sedimentation, pH, hardness and the like. The invention contemplates the addition of the additive to the feed water system at the earliest feasible point in the system.

Practice of the present invention will become more apparent from the following non-limiting examples.

EXAMPLE 1

The following experimental laboratory work shows that above a pH of 8.5, hydroquinone is an effective deoxygenation agent for water at room temperature (20° C.). The rate of the reaction is increased by higher pH and higher temperature. No catalyst is needed.

Tests were run in an oxygen bottle of 2 liter volume, with stirrer and oxygen electrode, at room temperature. Results are compared with those given by sodium sulfite, and hydrazine. Oxygen residuals as a function of time are shown in the table. The results with hydroquinone are very favorable when compared with the results given by other oxygen scavengers. In addition, there is none of the build-up of dissolved salts given by sulfite, and hydroquinone is much cheaper than hydrazine.

TABLE

| Time, Minutes | Dissolved Oxygen Concentration, ppm | | | | |
|---|---|---|---|---|---|
| | $Na_2SO_3$ | Hydroquinone | | | $N_2H_4$ |
| | 76 ppm | 5 ppm | 10 ppm | 20 ppm | 10 ppm |
| 0 | 8.75 | 8.85 | 8.85 | 8.80 | 8.40 |
| 1 | 6.40 | 4.15 | 0.50 | 0.20 | — |
| 2 | 4.70 | 3.90 | 0.12 | 0.02 | — |
| 3 | 3.50 | 3.78 | 0.11 | 0.00 | — |
| 4 | 2.60 | 3.70 | 0.10 | 0.00 | — |
| 5 | 1.95 | 3.60 | 0.10 | 0.00 | — |
| 10 | 0.48 | 3.15 | 0.05 | 0.00 | — |
| 15 | 0.15 | 2.82 | 0.00 | 0.00 | — |
| 30 | 0.00 | 2.20 | 0.00 | 0.00 | 8.00 |
| 24 hrs. | 0.00 | 1.00 | 0.00 | 0.00 | 3.05 |

EXAMPLE 2

This example sets forth a procedure recommended for use of the invention.

The boiler used is a Cleaver-Brooks, water tube, Model S-WTHP-7A-1250 Series 335, producing 150 lb pressure steam. Capacity 880,000 BTU/hour, equivalent horsepower 27 H.P. Feed water pump capacity is 18.3 gal per hour. The water used is partly recycled condensate and partly deep well makeup water.

A 5% aqueous solution of hydroquinone is made up, plus sufficient alkali to bring the pH to 8.5 to 11 and pumped to the feed water line. The amount used depends on the amount of oxygen in the feed water. The aim is to provide enough hydroquinone and alkali to maintain at least 0.1–1 ppm residual hydroquinone in the boiler water, while maintaining the pH over 8.5 in the feed lines. Analysis of residual hydroquinone should be made in the boiler water. The amount of hydroquinone fed is adjusted to maintain the above mentioned residual in the boiler water.

I have found that hydroquinone, added to the feed water at any point in the feed water system, at a pH above 8 and preferably 8.5–11, will react with the dissolved oxygen in the feed water and furnish corrosion protection to the metallic surfaces. The amount required is only 1–5 times the amount (by weight) of oxygen present, the reaction goes at room temperature, and the only requirement is an alkaline pH above 8.0, the higher the pH the faster the reaction.

Normal air saturated water contains 7–9 parts per million of oxygen depending on the temperature and atmospheric pressure. To maintain a small residual of hydroquinone, a little over 1 ounce hydroquinone per each 1,000 gallons of make-up is required for air saturated water. After the oxygen is scavenged, this results in a residual of about 0.1–1 ppm hydroquinone. Ground waters are usually far from air-saturated, surface water may be nearly saturated. The amounts of hydroquinone needed will be based on the amount of oxygen present and, since the water will generally not be air-saturated, will usually be considerably less than the amount mentioned above. The same residual, however, should be aimed at. The weight of additive:weight of oxygen in the feed water is about 0.1–20:1, and preferably about 1–5:1. The treatment can be added at any convenient point near the beginning of the feed water treatment system. Sufficient alkali should be added at the same time, if needed, to assure the proper pH level.

It will be understood that modifications and variations may be effected without departing from the spirit and scope of the novel concepts of this invention.

What is claimed is:

1. A method for control of corrosion of metal surfaces in a boiler system caused by dissolved oxygen in the water, which comprises adding to the said system an effective amount, from 0.1 to 20 parts by weight per part of the oxygen in the water of an oxygen scavenger selected from the group consisting of

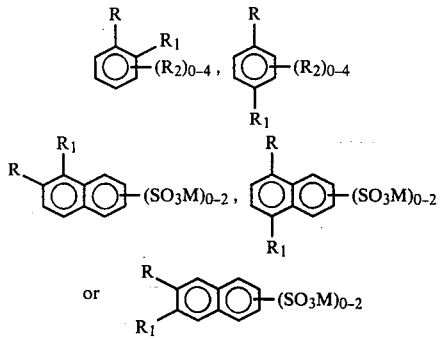

in which R and $R_1$ are independently selected from the group consisting of —OH or —$NH_2$; $R_2$ (when present) is lower alkyl containing 1–8 carbons: M is H, Na, or K: and combinations thereof; said group member being the sole oxygen scavenger present.

2. The method of claim 1 wherein the oxygen scavenger is used in an amount between 1 to about 5 times the weight of oxygen in the water.

3. The method of claim 1 or claim 2 wherein the oxygen scavenger is hydroquinone.

4. The method according to claim 1 in which the pH of the water in the boiler system is maintained above 8.

5. A method according to any of claims 1, 2, or 4 in which the metal surfaces are iron and/or steel; the scavenger is hydroquinone added to the feed water of the boiler; said feed water containing dissolved oxygen; the amount of hydroquinone as fed being 1–5 times the weight of oxygen in the feed water; the residual hydroquinone in the water in the boiler being maintained at about 0.1–1 ppm; and maintaining the pH of the boiler feed water within the range of 8–11.

* * * * *

REEXAMINATION CERTIFICATE (892nd)

United States Patent [19]

Kerst

[11] B1 4,278,635

[45] Certificate Issued Jul. 12, 1988

[54] METHOD FOR DEOXYGENATION OF WATER

[75] Inventor: Herman Kerst, Des Plaines, Ill.

[73] Assignee: Dearborn Chemical Co.

Reexamination Request:
No. 90/000,895, Oct. 31, 1985

Reexamination Certificate for:

| | |
|---|---|
| Patent No.: | **4,278,635** |
| Issued: | **Jul. 14, 1981** |
| Appl. No.: | **107,486** |
| Filed: | **Dec. 26, 1979** |

Related U.S. Application Data

[63] Continuation-in-part of Ser. No. 84,520, Oct. 12, 1979, abandoned.

[51] Int. Cl.[4] ..... C23F 11/06; C23F 11/12; C23F 11/14; C23F 11/16

[52] U.S. Cl. ..... 422/14; 210/757; 210/750; 252/178; 252/391; 252/392; 252/393; 422/16

[58] Field of Search ..... 422/14, 16; 210/750

[56] References Cited

U.S. PATENT DOCUMENTS

| | | |
|---|---|---|
| 1,988,823 | 1/1935 | Winning et al. . |
| 3,551,349 | 12/1970 | Kallfass . |
| 3,728,281 | 4/1973 | Marks et al. . |
| 3,843,547 | 10/1974 | Kaufman et al. . |
| 3,983,048 | 9/1976 | Schiessl et al. . |
| 4,022,711 | 5/1977 | Noack . |
| 4,026,664 | 5/1977 | Noack . |
| 4,079,018 | 3/1978 | Noack . |
| 4,096,090 | 6/1978 | Noack . |

FOREIGN PATENT DOCUMENTS

| | | |
|---|---|---|
| 51-93741 | 8/1976 | Japan . |

OTHER PUBLICATIONS

Kirk–Othmer, Encyclopedia of Chemical Technology, Second Edition, vol. 11, 1966, pp. 462, 469, 483–484.

Kirk–Othmer, Encyclopedia of Chemical Technology, Second Edition, vol. 2, 1963, p. 213.

Green et al, The Influence of Hydroxyl Ion . . . Hydroquinone, J.A.C.S., 63, 1941, pp. 3441–3444.

*Primary Examiner*—M. S. Marcus

[57] ABSTRACT

A method for boiler water treatment to retard corrosion due to dissolved oxygen. Hydroquinone and certain related compounds are highly effective oxygen scavengers for use in boiler water and thereby effect reduction of corrosion resulting from dissolved oxygen.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claim 2 is cancelled.

In Interference No. 101,126 final judgement adverse to the patent owner was rendered April 15, 1987, as to claims 1, 3, 4 and 5.

* * * * *